US010059119B2

(12) United States Patent
Shimomura

(10) Patent No.: US 10,059,119 B2
(45) Date of Patent: Aug. 28, 2018

(54) RECORDING APPARATUS

(71) Applicant: SEIKO EPSON CORPORATION, Tokyo (JP)

(72) Inventor: Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/668,467

(22) Filed: Aug. 3, 2017

(65) Prior Publication Data

US 2018/0050534 A1 Feb. 22, 2018

(30) Foreign Application Priority Data

Aug. 17, 2016 (JP) ..... 2016-159898

(51) Int. Cl.

| | |
|---|---|
| ***B41J 2/185*** | (2006.01) |
| ***B41J 2/175*** | (2006.01) |
| ***B41J 29/02*** | (2006.01) |
| ***B41J 29/13*** | (2006.01) |
| *B41J 2/01* | (2006.01) |

(52) U.S. Cl.

CPC ..... *B41J 2/185* (2013.01); *B41J 2/175* (2013.01); *B41J 2/1752* (2013.01); *B41J 29/02* (2013.01); *B41J 29/13* (2013.01); *B41J 2002/012* (2013.01); *B41J 2002/1853* (2013.01)

(58) Field of Classification Search

CPC ... B41J 2/185; B41J 29/13; B41J 2/175; B41J 29/02; B41J 2/1752; B41J 2002/012; B41J 2002/1853

See application file for complete search history.

(56) References Cited

FOREIGN PATENT DOCUMENTS

| | | | | |
|---|---|---|---|---|
| JP | 06-278290 | * | 10/1994 | ..... B41J 2/175 |
| JP | 06-278290 | A | 10/1994 | |
| JP | 2005-219233 | A | 8/2005 | |
| JP | 2007-223244 | A | 9/2007 | |

* cited by examiner

*Primary Examiner* — Yaovi M Ameh
(74) *Attorney, Agent, or Firm* — Workman Nydegger

(57) ABSTRACT

Disclosed is a recording apparatus that includes a recording head that ejects a liquid onto a medium, a liquid housing unit that houses the liquid, a supply path of the liquid from the liquid housing unit to the recording head, an assembly body that includes the recording head, a liquid receiving tray that receives the liquid leaking from the assembly body below the assembly body and that has an opening portion which opens at a position higher than a bottom portion.

11 Claims, 14 Drawing Sheets

RECORDING APPARATUS

CROSS REFERENCES TO RELATED APPLICATIONS

The entire disclosure of Japanese Patent Application No. 2016-159898, filed Aug. 17, 2016 is expressly incorporated by reference herein.

BACKGROUND

1. Technical Field

The present disclosure relates to a recording apparatus that performs recording on a recording medium.

2. Related Art

Hereinafter, an ink jet printer will be described as an example of a recording apparatus. Because ink used in an ink jet printer is a liquid, in some cases, ink may begin to leak out for some reason from an ink supply flow channel extending from an ink housing unit that houses ink to a recording head, an ink flow channel extending from a cap that caps the recording head to a waste liquid tank that stores waste ink via a suction pump or the like. When ink leaks out, there is a concern that the leaked ink may flow to a bottom portion of the apparatus and consequently drip onto a mounting surface of the apparatus thereby contaminating the mounting surface.

In view of such a situation, JP-A-6-278290 discloses an ink jet recording apparatus provided with an ink-receiving container at the bottom of the apparatus.

The bottom surface of the apparatus may be provided with legs that receive the load of the apparatus. The legs are often formed of an elastic material such as rubber and, for example, play a role of protecting the device from vibration and shock.

In the ink jet recording apparatus described in JP-A-6-278290, from the disclosure contents of FIG. 1 and the configuration of the ink-receiving container illustrated in FIG. 3 and the like, it can be seen that the legs of the bottom portion of the apparatus are provided at the four corners of the bottom portion of the apparatus.

When the legs of the bottom portion of the apparatus are provided only at the four corners of the bottom portion of the apparatus, there is a risk that the legs at the bottom portion of the apparatus cannot appropriately bear the weight of the apparatus depending on weight of the apparatus and the size of the apparatus.

However, if an ink-receiving container similar to that described in JP-A-6-278290 is provided at the bottom portion of the apparatus, the following problems occur when legs are provided at positions other than the four corners of the bottom portion of the apparatus.

For example, if legs are attached to the ink-receiving container, the ink-receiving container may become deformed. In addition, in the case where the ink-receiving container is provided in a plurality so as to avoid the legs, it takes time to install the ink-receiving containers and, at the same time, regions where the ink-receiving containers are not provided are formed thus increasing the risk of ink leakage. Also, if one ink-receiving container is used and holes are formed in the ink-receiving container that allow passage of the legs at the positions where the legs are to be provided, the ink may easily leak out from the holes when the apparatus is tilted.

Since an optional device such as an optional cassette may be provided at the bottom portion of the recording apparatus, the above-mentioned problem is not limited to the case where legs are provided at the bottom portion of the apparatus, but also applies to the case where an engagement portion to be engaged with the optional device is provided at the bottom portion of the apparatus.

SUMMARY

An advantage of some aspects of the disclosure is that a recording apparatus is provided with a liquid-receiving tray for receiving a liquid, which secures the degree of freedom of the configuration of the bottom portion of the apparatus and prevents or suppresses leakage of the liquid.

A recording apparatus according to an aspect of the disclosure includes a recording head that ejects a liquid onto a medium, a liquid housing unit that houses the liquid, a supply path of the liquid from the liquid housing unit to the recording head, an assembly body that includes the recording head, a liquid-receiving tray that receives the liquid leaking from the assembly body below the assembly body and that has an opening portion which opens at a position higher than a bottom portion of the liquid-receiving tray.

The liquid-receiving tray can receive the liquid leaking from the assembly body including the recording head. Moreover, because the opening portion is formed in the liquid-receiving tray, the bottom portion of the assembly body can be accessed via the opening portion and, for example, it is possible to provide a leg portion that can receive the load of the apparatus. That is, while providing the ink-receiving tray, the degree of freedom of the configuration of the bottom portion of the apparatus can be secured, and, at the same time, a wide area of the liquid-receiving tray can also be secured.

Because the opening portion opens at a position higher than the bottom portion, even if the liquid staying at the bottom of the tray flows when the apparatus is tilted, the liquid does not leak easily from the opening portion.

As described above, in the configuration providing the liquid-receiving tray that receives the liquid, leakage of the liquid can be prevented or suppressed while securing the degree of freedom of the configuration of the bottom portion of the apparatus.

In this case, the opening portion may be at a position higher than the peripheral portion of the liquid-receiving tray.

Because the opening portion is at a position that is higher than the peripheral portion of the liquid-receiving tray, it is possible to prevent or suppress leakage of liquid from the opening portion in the period until the liquid-receiving tray becomes full with the liquid.

In this case, a housing that covers the assembly body may be included, a leg portion that receives a load of the assembly body is attached, via the opening portion, to a lower frame that forms a lower portion of the assembly body, and the liquid-receiving tray has a peripheral portion that is located between an inner wall of the housing and the leg portion in a direction intersecting the apparatus height direction.

Because the housing that covers the assembly body is included, a leg portion that receives a load of the assembly body is attached to a lower frame that forms a lower portion of the assembly body via the opening portion, and the liquid-receiving tray has a peripheral portion that is located between an inner wall of the housing and the leg portion in a direction intersecting the device height direction, it is possible to secure a wide area of the liquid-receiving tray.

In this case, the peripheral portion of the liquid-receiving tray may extend toward the inner wall of the housing and face the inner wall.

Because the peripheral portion of the liquid-receiving tray may extend toward the inner wall of the housing and face the inner wall, it is possible to delay the timing at which the liquid leaks out from the peripheral portion when the apparatus is tilted.

In this case, a protrusion that protrudes upward and in which the opening portion is formed in an upper portion thereof may be formed in the liquid-receiving tray, and the leg portion may be fixed to the lower frame in a state in which at least one portion of the leg portion is inserted into an inner space of the protrusion.

Because the protrusion that protrudes upward and in which the opening portion is formed in an upper portion thereof may be formed in the liquid-receiving tray, and the leg portion may be fixed to the lower frame in a state in which at least one portion of the leg portion is inserted into an inner space of the protrusion, the height of the apparatus including the leg portion can be reduced.

In this case, a medium housing unit that houses a medium on a lower side of the assembly body and the liquid-receiving tray may be included, and the liquid-receiving tray may be located between the assembly body and the medium housing unit.

Because a medium housing unit that houses a medium on a lower side of the assembly body and the liquid-receiving tray may be included, and the liquid-receiving tray may be located between the assembly body and the medium housing unit, it is possible to prevent or suppress the adhesion of a liquid to the medium housing unit.

In this case, a protrusion that protrudes upward and in which the opening portion is formed in an upper portion thereof may be formed in the liquid-receiving tray, a positioning portion protruding toward the assembly body and engaging with the assembly body so as to set a position of the assembly body may be formed in the medium housing portion, and the positioning portion may engage with the assembly body through the opening portion with at least a portion of the positioning portion entering the internal space of the protrusion.

Because the positioning portion may engage with the assembly body through the opening portion with at least a portion of the positioning portion entering the internal space of the protrusion, it is possible to suppress the height of the apparatus including the medium housing unit.

In this case, a protrusion that protrudes upward and in which the opening portion is formed in an upper portion thereof may be formed in the liquid-receiving tray, a connecting portion that protrudes toward the assembly body and that is connected to the assembly body may be provided in the medium housing unit, and the connecting portion may come into contact with the assembly body through the opening portion with at least a portion of the connecting portion entering the internal space of the protrusion.

In the configuration in which the medium housing unit and the assembly body are connected to each other, the above-described operational effect can be obtained.

In this case, the liquid-receiving tray may be provided with a liquid absorber that absorbs liquid.

Because the liquid-receiving tray may be provided with a liquid absorber that absorbs the liquid, it is possible to suppress the flow of the liquid inside the liquid-receiving tray and suppress the leakage of the liquid from the liquid-receiving tray.

In this case, an intermediate unit that includes a check valve may be provided in the supply path from the liquid housing unit to the recording head, and a liquid storage capacity of the liquid may be equal to or larger than a capacity of the liquid when the liquid fills at least the supply path of the liquid between the intermediate unit and the recording head.

Because an intermediate unit that includes a check valve may be provided in the supply path from the liquid housing unit to the recording head, and a liquid storage capacity of the liquid is equal to or larger than a capacity of the liquid when the liquid fills at least the supply path of the liquid between the intermediate unit and the recording head, even if the leakage capacity of the liquid is the maximum (worst), this can be dealt with.

In this case, the liquid-receiving tray need not bear the load of the assembly body.

Because the liquid-receiving tray need not bear the load of the assembly body, deformation of the liquid-receiving tray can be prevented.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, embodiments of the disclosure will be described with reference to the drawings. In addition, the same reference signs will be used to refer to similar structures in the embodiments, and these structures will only be described in the first embodiment and description thereof will be omitted in subsequent embodiments.

Figure 1:
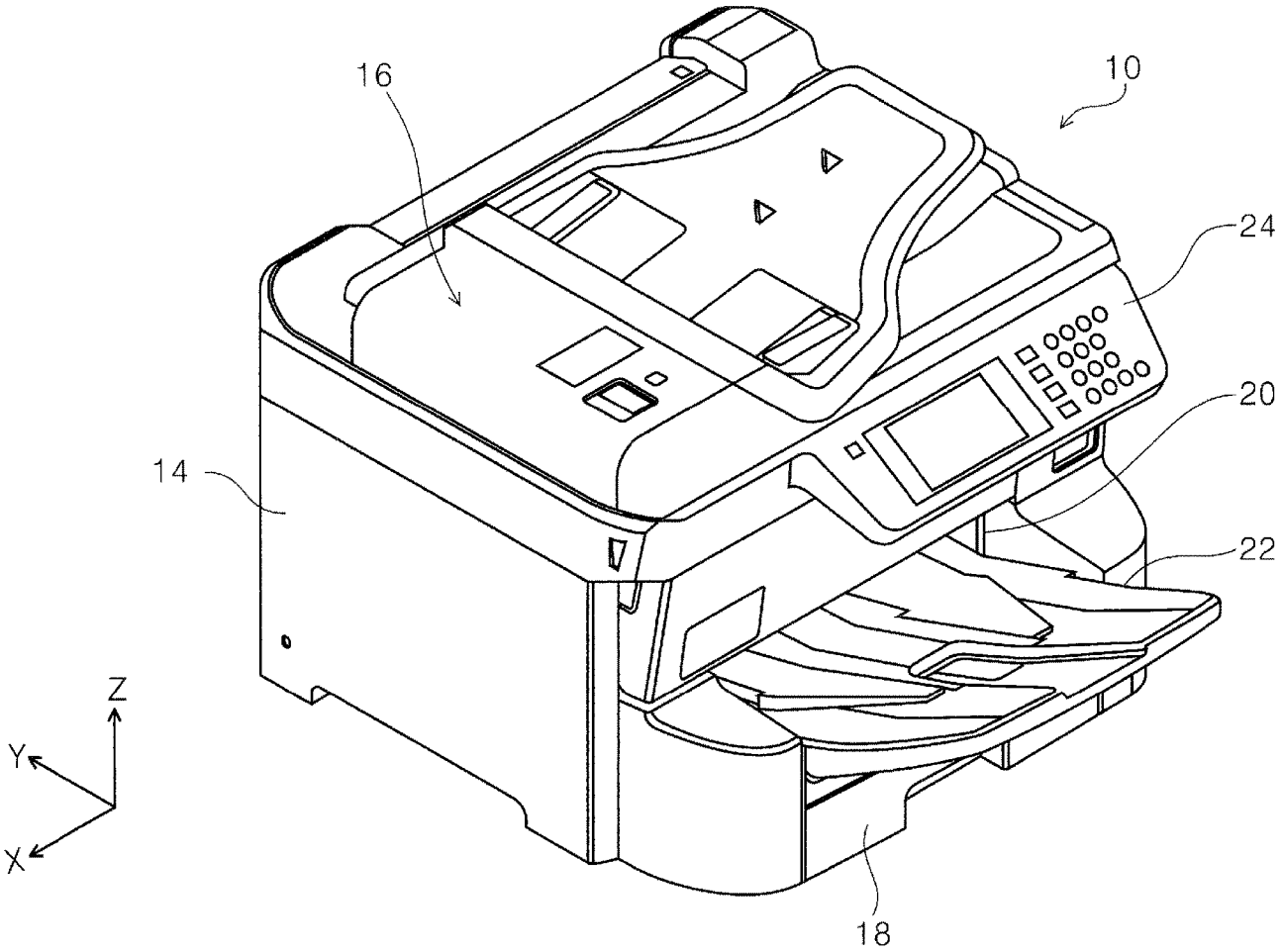
FIG. 1 is an external perspective view of a printer according to the disclosure.
Figure 2:
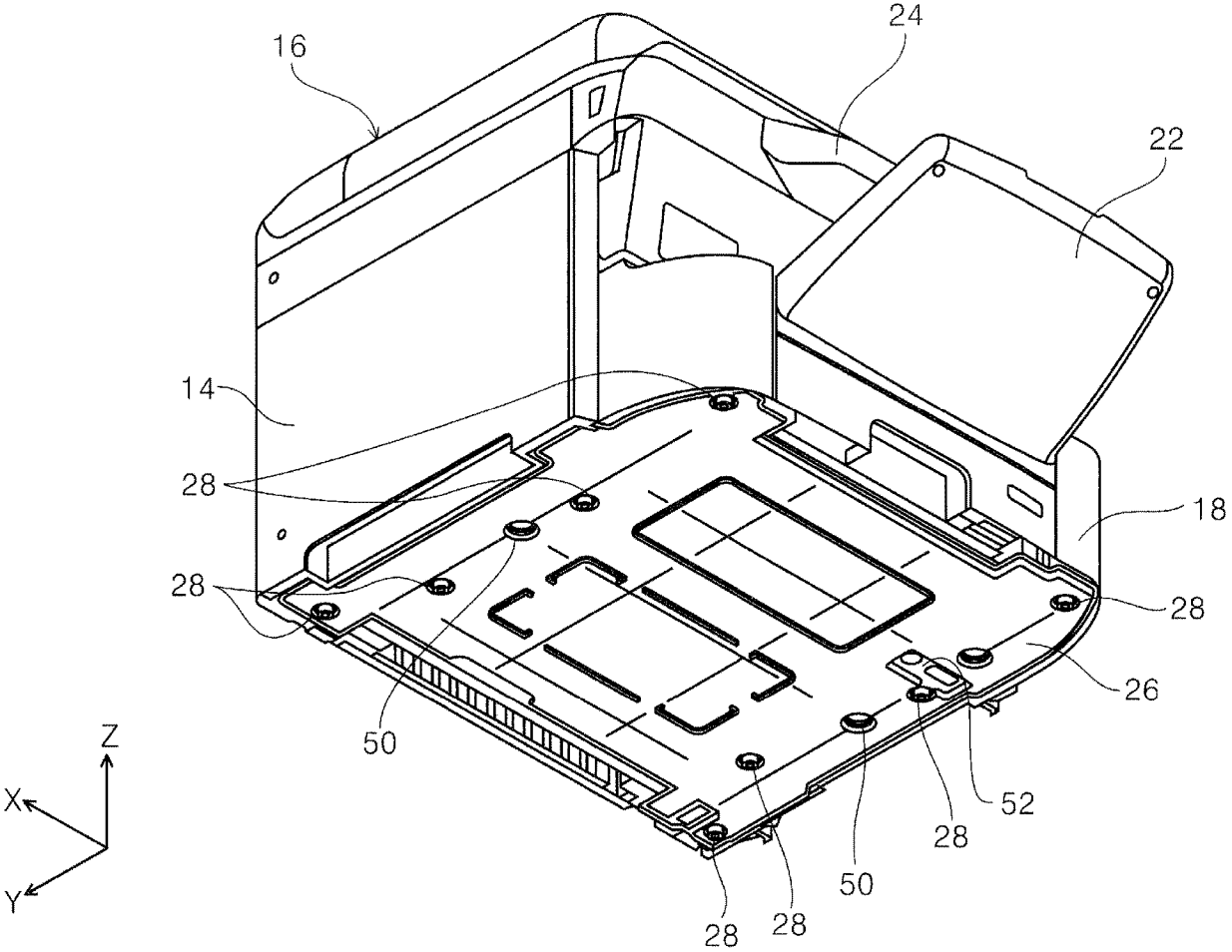
FIG. 2 is an external perspective view of the printer according to the disclosure viewed from a bottom portion side of the printer.
Figure 3:
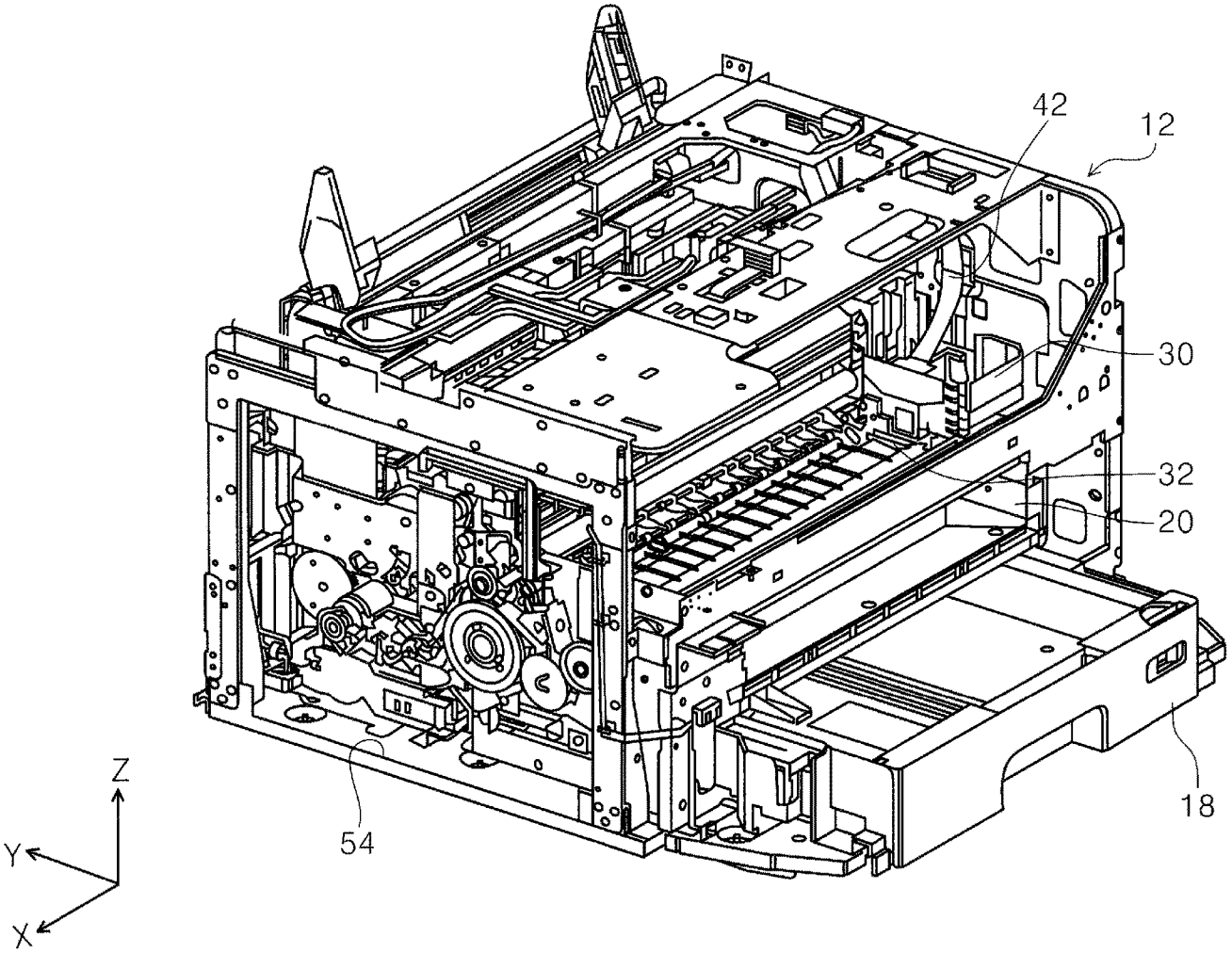
FIG. 3 is a perspective view of an assembly body of the printer according to the disclosure.
Figure 4:
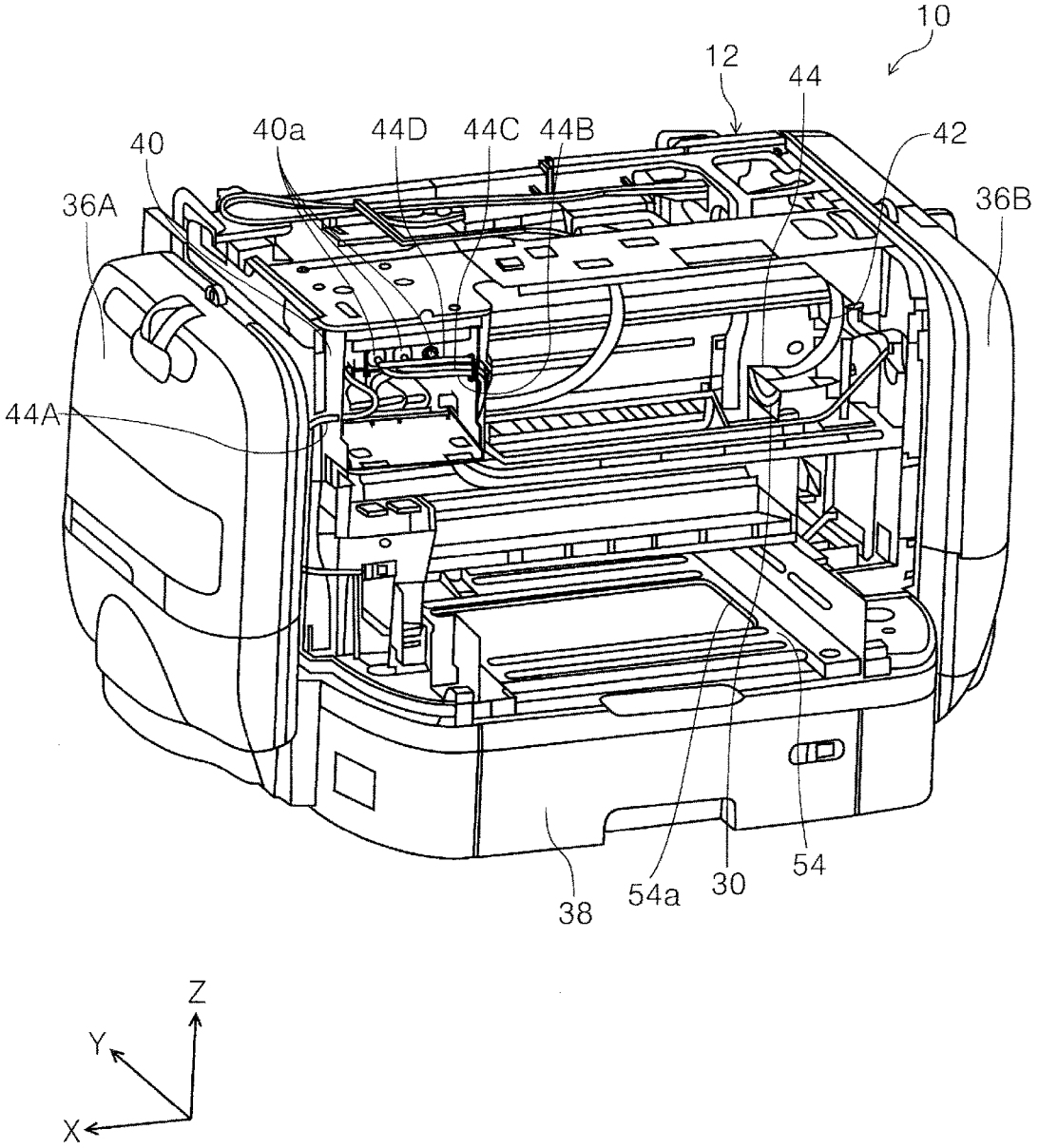
FIG. 4 is a perspective view of the assembly body in a state in which a medium housing unit is added thereto.
Figure 5:
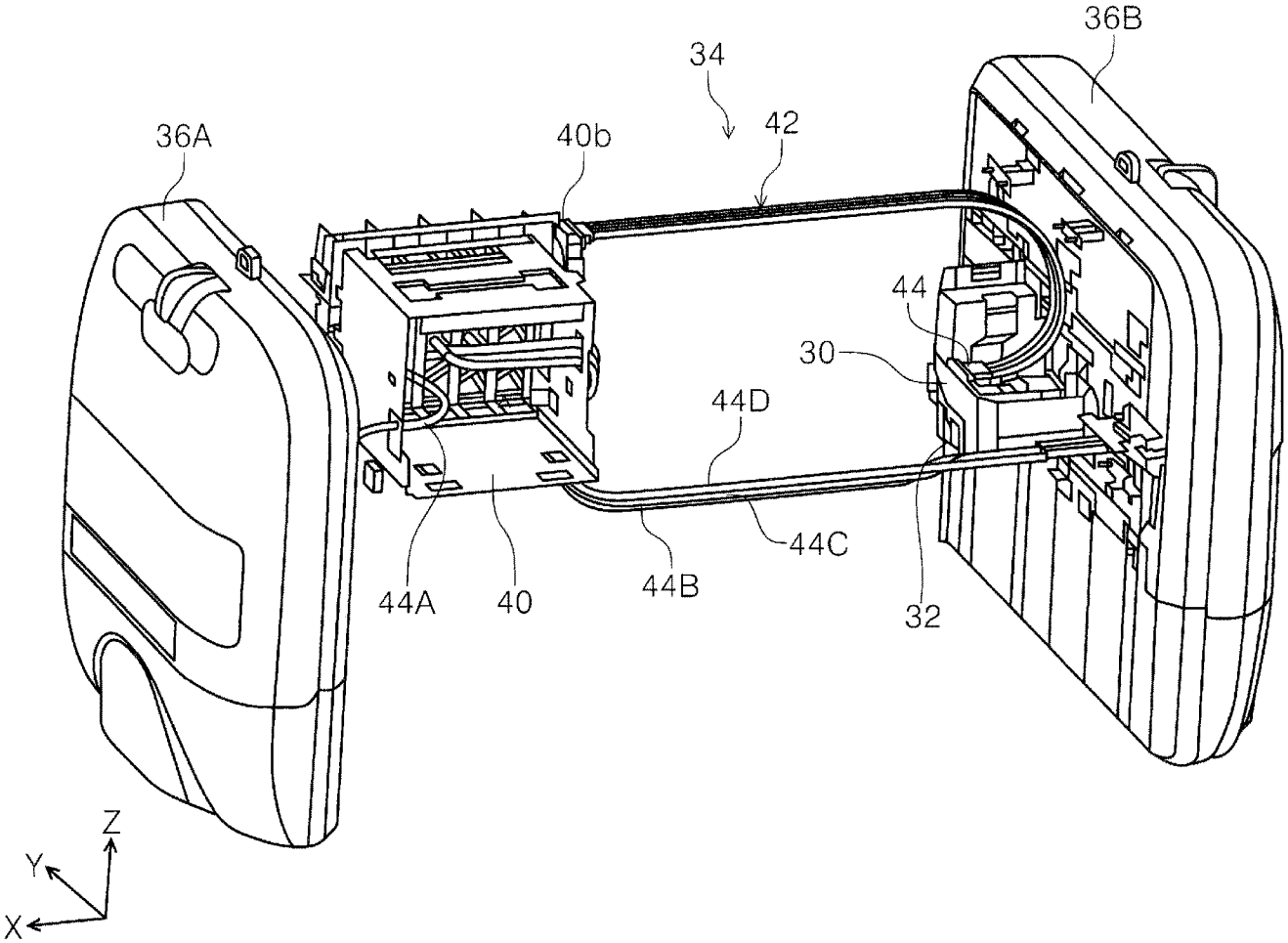
FIG. 5 is a perspective view of a supply path that supplies ink to a recording head.
Figure 6:
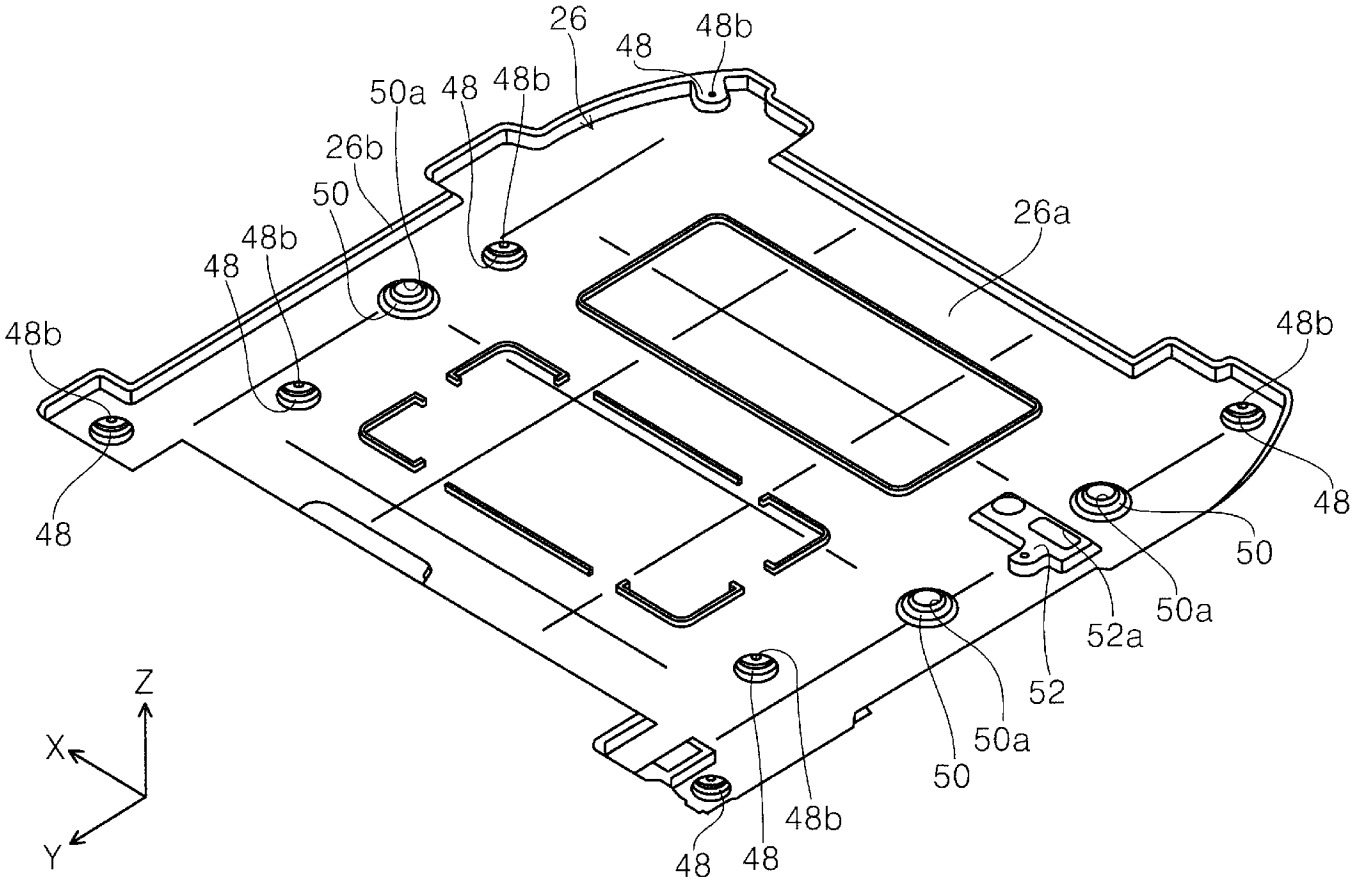
FIG. 6 is a perspective view of an ink-receiving tray viewed from a lower side of the ink-receiving tray.

FIG. 1 is an external perspective view of a printer according to the disclosure, FIG. 2 is an external perspective view of the printer according to the disclosure viewed from a bottom portion side of the printer, FIG. 3 is a perspective view of an assembly body of the printer according to the disclosure, FIG. 4 is a perspective view of the assembly body in a state in which a medium housing unit is added thereto, FIG. 5 is a perspective view of a supply path that supplies ink to a recording head, and FIG. 6 is a perspective view of an ink-receiving tray viewed from a lower side of the ink-receiving tray.

Figure 7:
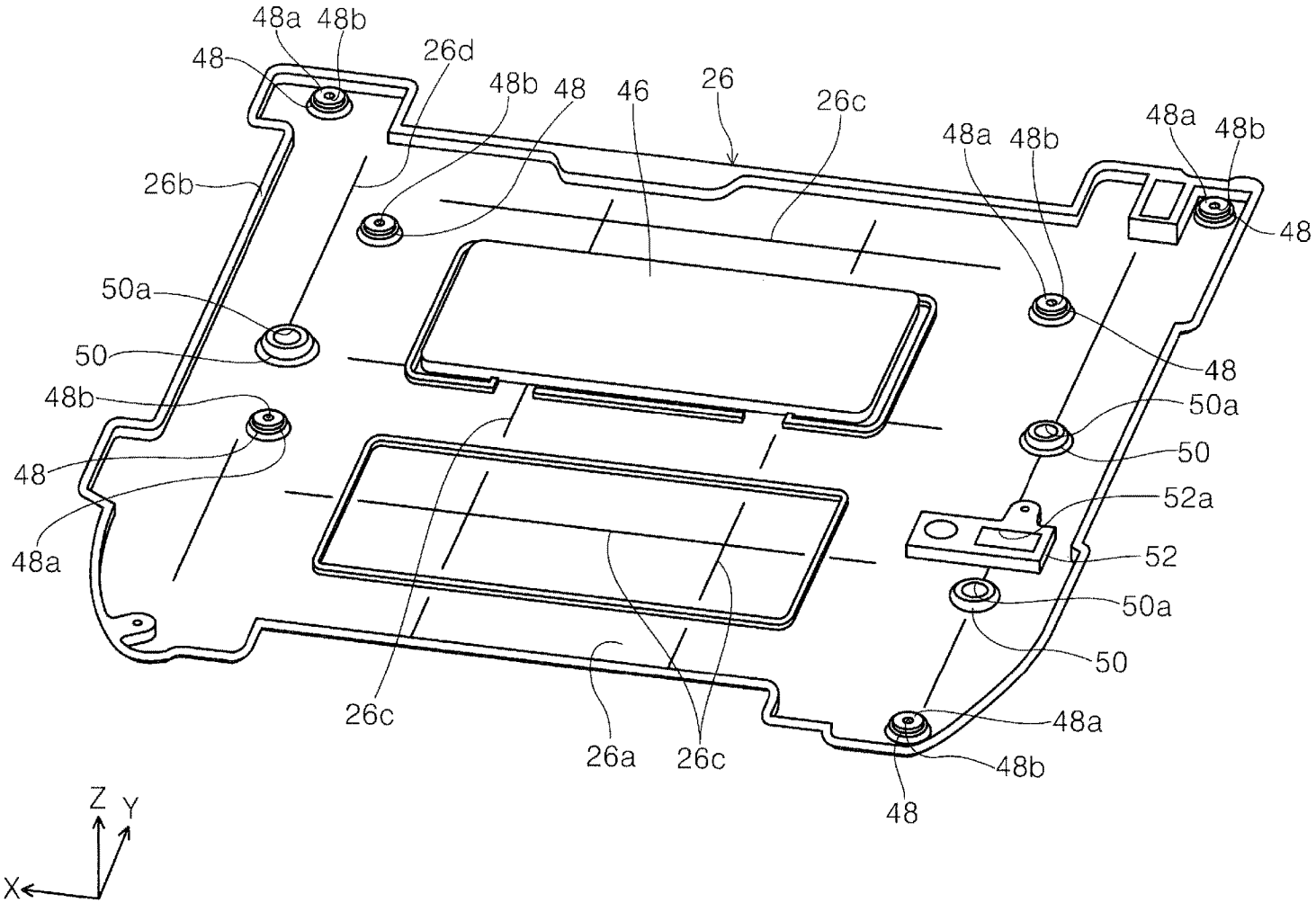
FIG. 7 is a perspective view of an ink-receiving tray viewed from an upper side of the ink-receiving tray.
Figure 8:
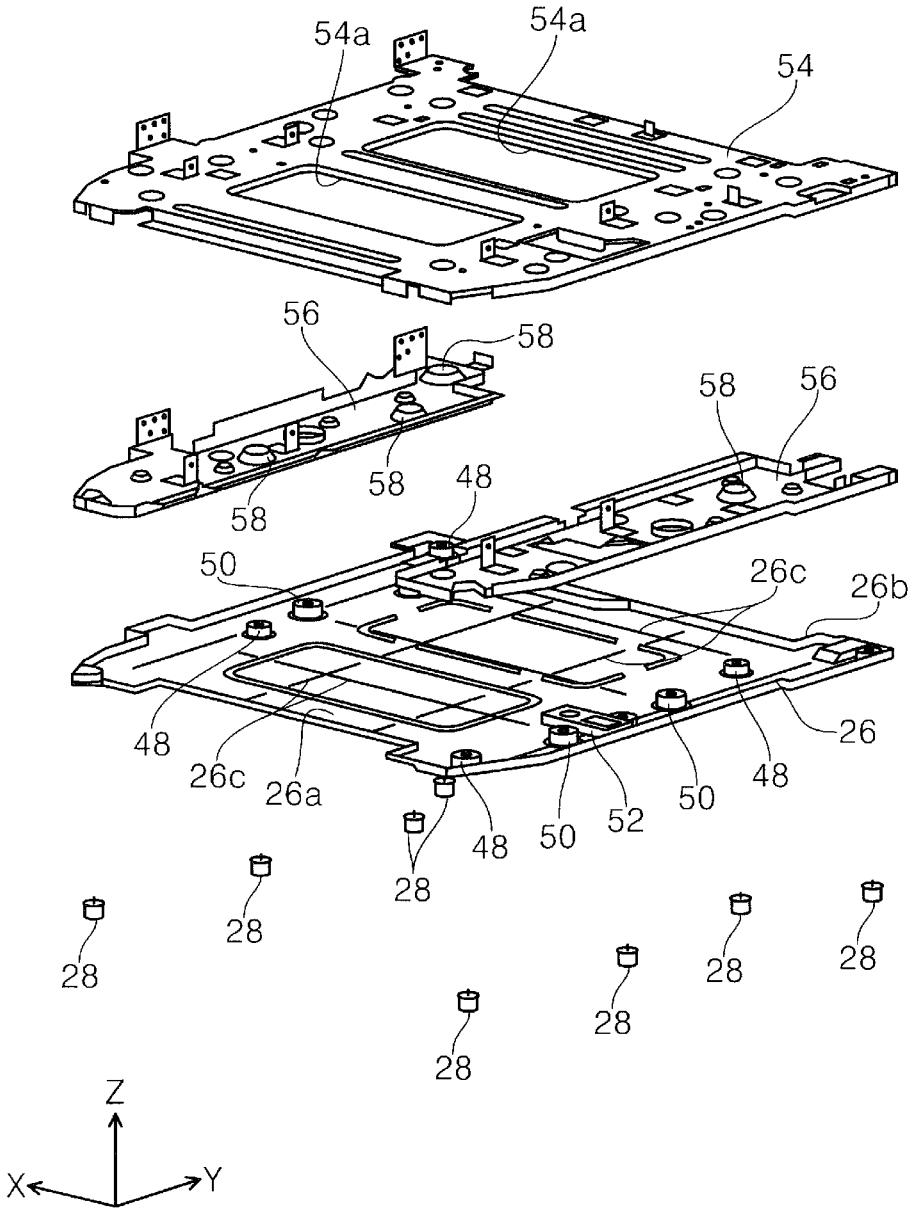
FIG. 8 is an exploded perspective view of a lower portion frame, an ink-receiving tray and leg portions.
Figure 9:
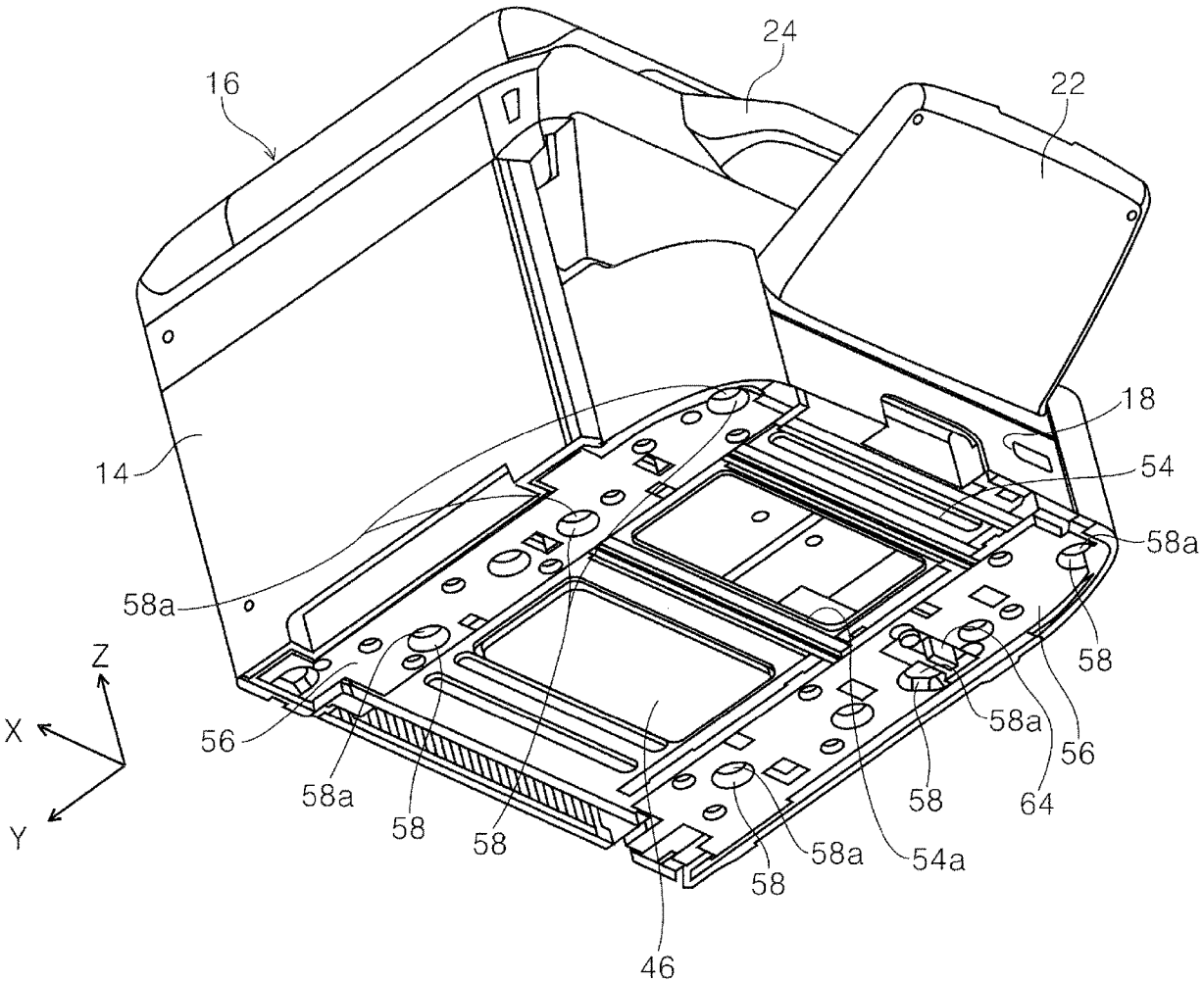
FIG. 9 is a perspective view of a lower portion of the printer according to the disclosure in a state in which the ink-receiving tray is removed from the printer.
Figure 10:
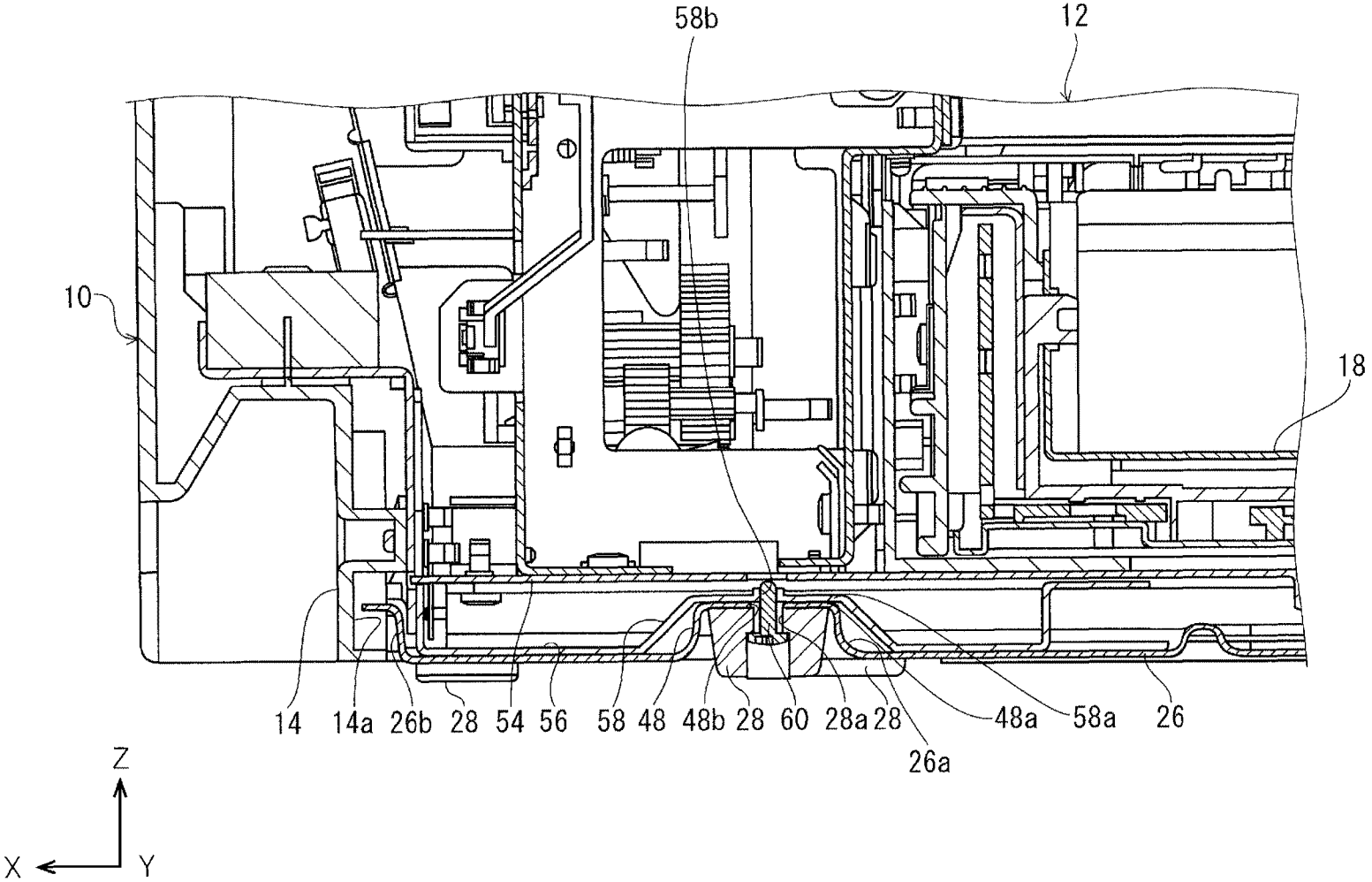
FIG. 10 is a cross-sectional view of the lower portion frame, the ink-receiving tray and the leg portions viewed from an apparatus-depth-direction front surface side.
Figure 11:
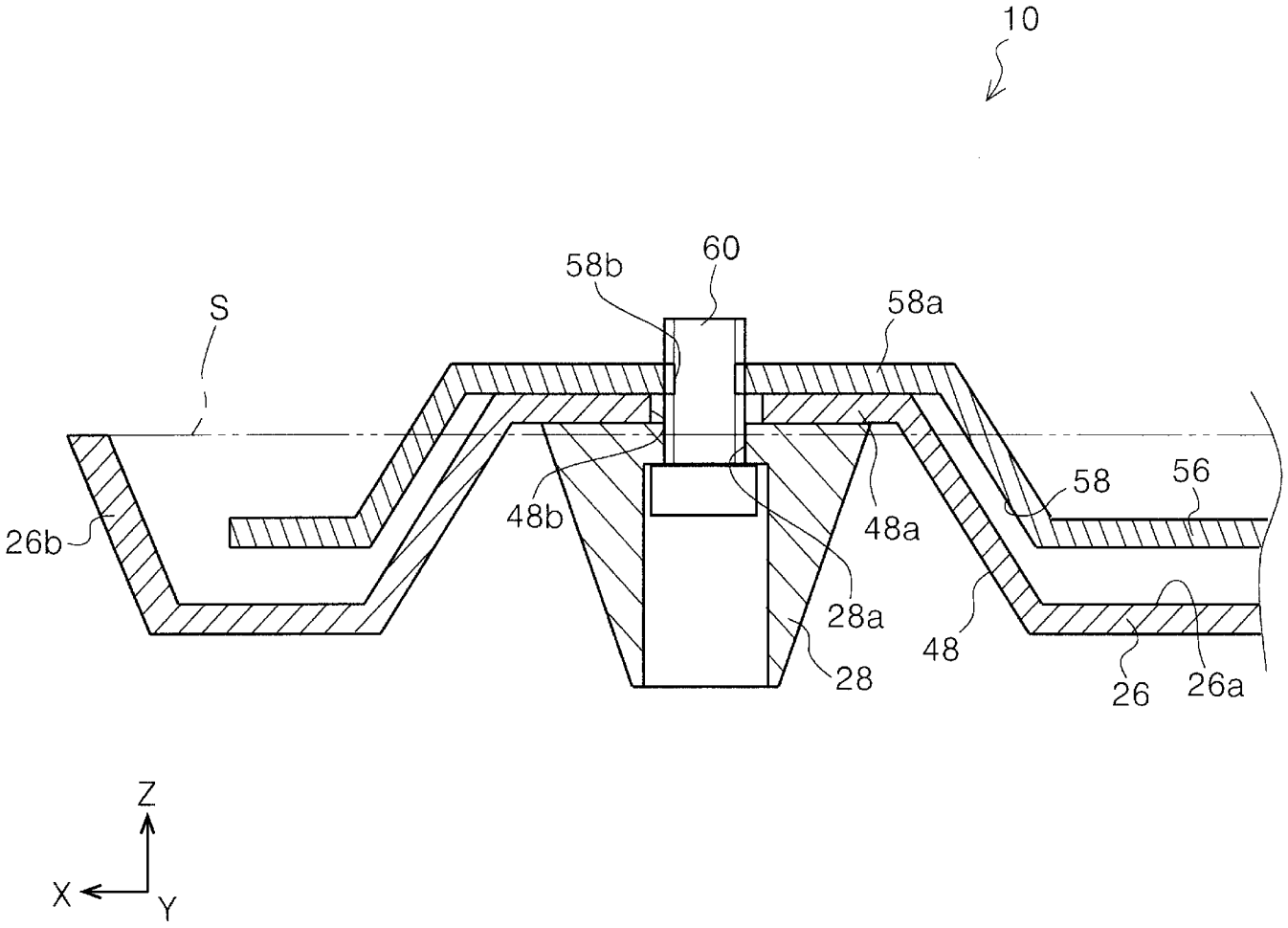
FIG. 11 is a cross-sectional view of an attachment portion of a leg portion of the ink-receiving tray for explaining a relationship between a liquid surface of ink housed in the ink-receiving tray and an opening portion.
Figure 12:
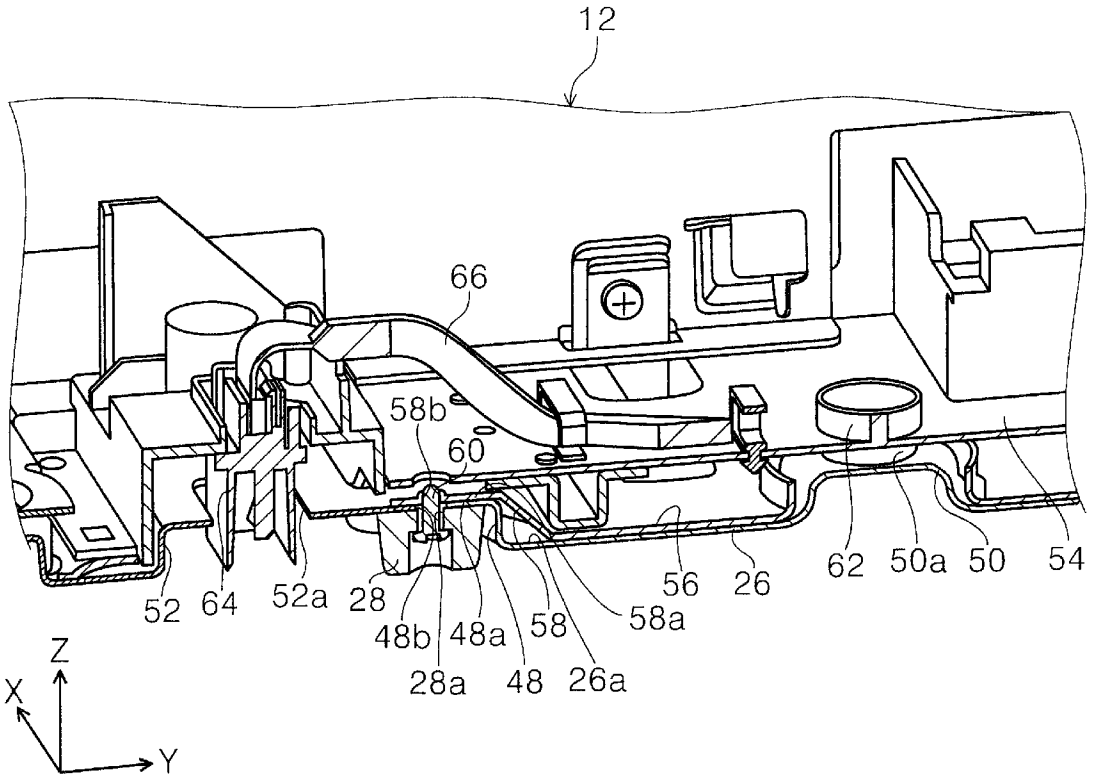
FIG. 12 is a cross-sectional view of an engagement portion of the assembly body to be engaged with an optional medium housing unit.
Figure 13:
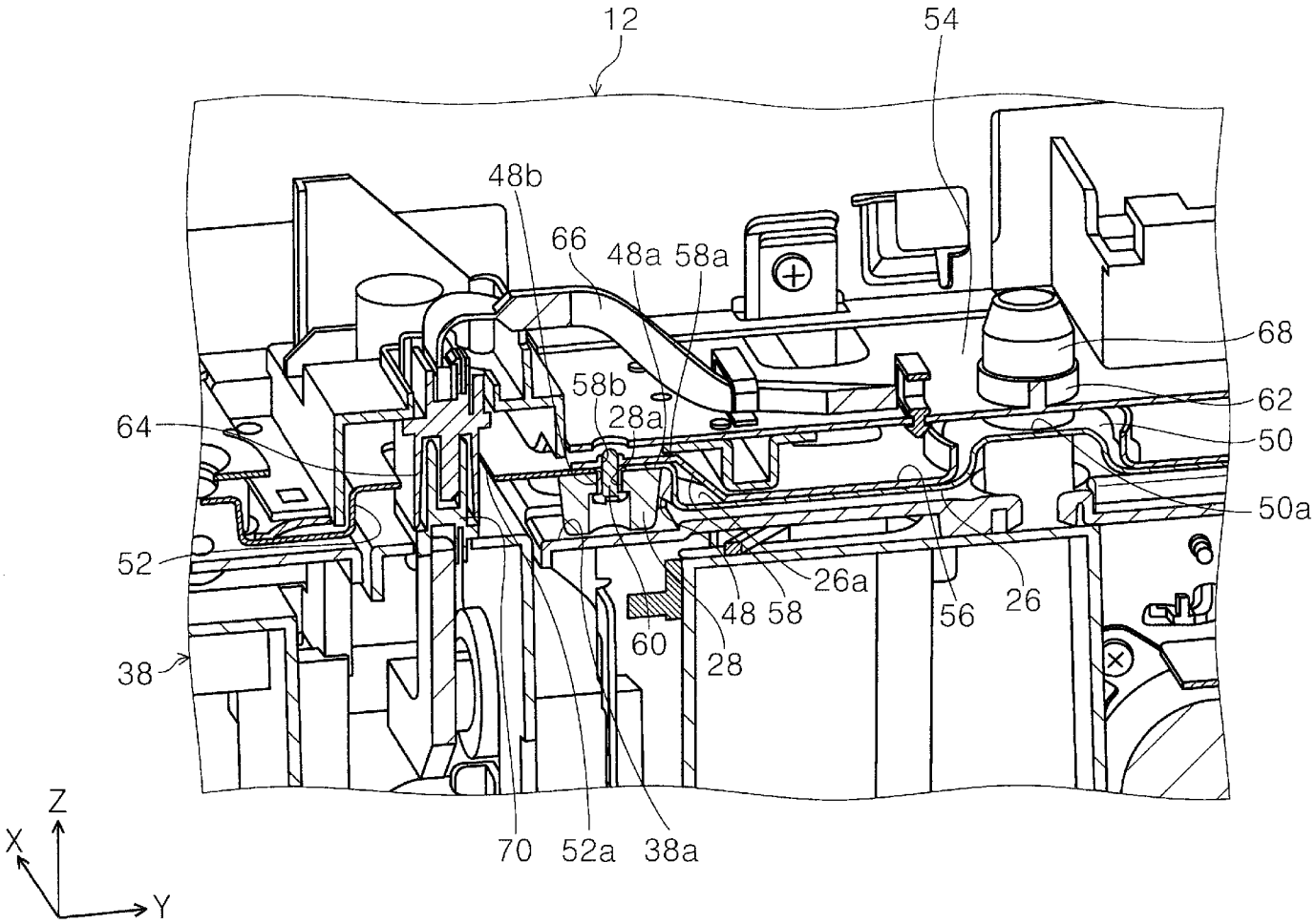
FIG. 13 is a cross-sectional view of the engagement portion in a state where the assembly body and the optional medium housing unit engage each other.
Figure 14:
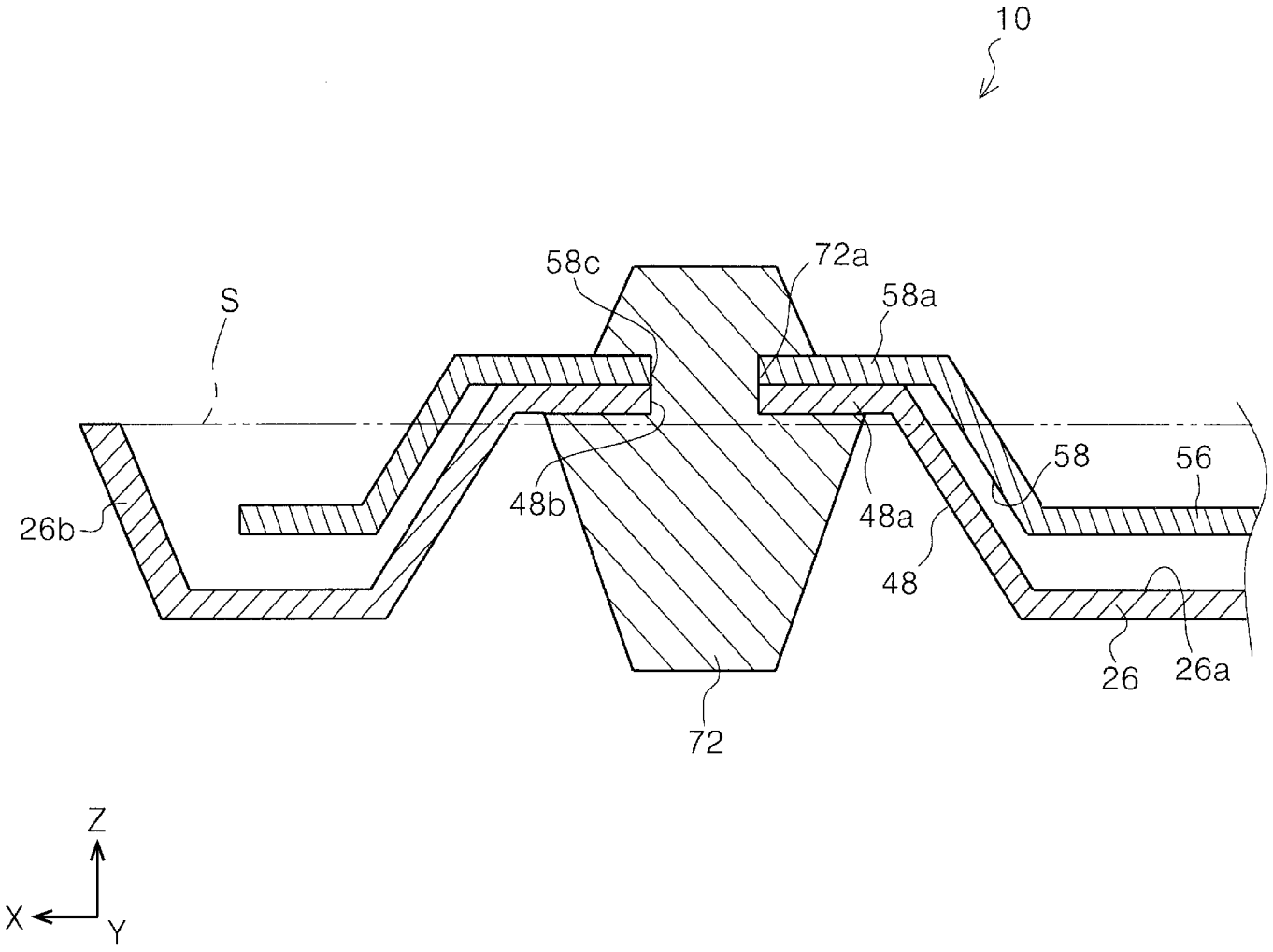
FIG. 14 is a side cross-sectional view showing a modified example of a leg portion.

FIG. 7 is a perspective view of an ink-receiving tray viewed from an upper side of the ink-receiving tray, FIG. 8 is an exploded perspective view of a lower portion frame, an ink-receiving tray and leg portions, FIG. 9 is a perspective view of a lower portion of the printer according to the disclosure in a state in which the ink-receiving tray is removed from the printer, FIG. 10 is a cross-sectional view of the lower portion frame, the ink-receiving tray and the leg portions from an apparatus-depth-direction front surface side, FIG. 11 is a cross-sectional view of an attachment portion of a leg portion of the ink-receiving tray for explaining a relationship between a liquid surface of ink housed in the ink-receiving tray and an opening portion, FIG. 12 is a cross-sectional view of an engagement portion of the assembly body with an optional medium housing portion, FIG. 13 is a cross-sectional view of the engagement portion in a state where the assembly body and the optional medium housing portion engage each other, FIG. 14 is a side cross-sectional view showing a modified example of a leg portion.

Moreover, in the X-Y-Z coordinate system illustrated in each diagram, the X direction corresponds to a main scanning direction of a carriage (movement direction), that is, a width direction of a recording apparatus, the Y direction corresponds to a depth direction of the recording apparatus, and the Z direction corresponds to an apparatus height direction. In addition, in each diagram, the +X direction side corresponds to the left side of the apparatus, the −X direction corresponds to the right side of the apparatus, the −Y direction side corresponds to the front surface side of the apparatus, the +Y direction side corresponds to the rear surface side of the apparatus, the +Z direction side corresponds to the upper side of the apparatus, and the −Z direction side corresponds to the lower side of the apparatus.

First Embodiment

Summary of Printer

Referring to FIG. 1 to FIG. 3, a printer 10 as the "recording apparatus" of this embodiment includes an assembly body 12 (refer to FIG. 3), a housing 14 that covers the assembly body 12, and a scanner unit 16 that is arranged above the assembly body 12 and that is capable of rotating with respect to the assembly body.

The housing 14 is, for example, a cover that covers the periphery of the assembly body 12. The housing 14 may be formed of, for example, a resin material.

A first medium housing unit 18 that is detachable from the assembly body 12 is provided in a lower portion of the printer 10. The first medium housing unit 18 is capable of being inserted into and removed from the assembly body 12 from the apparatus-depth-direction front surface side.

On the apparatus-depth-direction front surface side of the printer 10, a discharge opening 20 and a discharge tray 22 are provided on an apparatus-height-direction upper side of the first medium housing unit 18. Moreover, on the apparatus-depth-direction front surface side of the printer 10, an operation unit 24 is provided above the discharge opening 20 and the discharge tray 22. As illustrated in FIG. 1, the operation unit 24 is provided with a display unit such as a liquid crystal panel and an input unit having a plurality of input buttons, switches and the like.

Moreover, as illustrated in FIG. 2, an ink-receiving tray 26 serving as the "liquid-receiving tray" is provided in a bottom portion of the printer 10, that is, a bottom portion of the assembly body 12. Moreover, a plurality of leg portions 28 are attached to the bottom portion of the assembly body 12 via the ink-receiving tray 26. In addition, the ink-receiving tray 26 and the leg portions 28 will be described later.

Next, as illustrated in FIG. 3, within the assembly body 12, a carriage 30 is capable of reciprocating in the apparatus width direction by a driving unit (not illustrated). A recording head 32 that ejects ink as the "liquid" towards a medium is provided in a lower portion of the carriage 30.

Here, a recording operation performed on a medium in the printer 10 will be described. A medium housed in the first medium housing unit 18 is sent to a region facing the recording head 32 of the carriage 30 by a feeder (not illustrated). The medium receives the ink ejected from the recording head 32 and recording is performed in the region facing the recording head 32. Then, the medium on which recording has been performed is discharged toward the discharge tray 22 through the discharge opening 20.

Ink Supply Path of Recording Head

Next, an ink supply path 34 that extends to the recording head 32 in the printer 10 will be described with reference to FIG. 4 and FIG. 5. In addition, in FIG. 4 and FIG. 5, the printer 10 is in a state in which ink tanks 36A and 36B, which are of a large capacity and optional, as examples of the "liquid housing unit" are installed therein. In addition, in FIG. 4, the printer 10 is in a state in which a second medium housing unit 38 is optionally installed below the ink-receiving tray 26.

Referring to FIG. 4, an intermediate unit 40 is provided in the apparatus-width-direction left end portion of the assembly body 12. The intermediate unit 40 is formed in a box shape having an opening on the apparatus-depth-direction front surface side. A plurality of ink connectors 40*a* are provided on the apparatus-depth-direction rear-surface-side end portion of the intermediate unit 40. The ink connectors 40*a* are, for example, each provided with a check valve.

As illustrated in FIG. 5, a plurality of ink tubes 42 extend from an ink tube connecting portion 40*b* provided in the intermediate unit 40 toward the carriage 30. A connector 44 is attached to the tips of the ink tubes 42. The ink tubes 42 are connected to the carriage 30 via the connector 44. In addition, the ink tube connecting portion 40*b* is also provided with a check valve.

As illustrated in FIG. 4 and FIG. 5, for example, the ink tanks 36A and 36B are added to the printer 10. The ink tanks 36A and 36B supply ink to the recording head 32 via the intermediate unit 40.

Specifically, ink tubes 44A, 44B, 44C, and 44D extending from the ink tanks 36A and 36B are respectively connected to the plurality of ink connectors 40*a* of the intermediate unit 40. The ink supply path 34 supplies ink from the ink tanks 36A and 36B to the recording head 32 via the ink tubes 44A, 44B, 44C, and 44D, the intermediate unit 40 and the ink tubes 42. In addition, for example, black ink is housed in the ink tank 36A and magenta, cyan, and yellow color inks are housed in the ink tank 36B.

In addition, in the above-described embodiment, the ink tanks 36A and 36B are used; however, it is possible to adopt a configuration in which an optional ink tank is not provided. For example, it is also possible to adopt a configuration in which an ink cartridge housing unit (not illustrated) is provided instead of the intermediate unit 40, and a plurality of ink cartridges (not illustrated), which are examples of the "liquid housing unit", are detachable from the apparatus-depth-direction front surface side of this ink cartridge housing unit. In such a case, the ink contained in the ink cartridges installed in the ink cartridge housing unit is supplied to the recording head 32 via the ink tubes 42. In addition, for example, inks such as black, magenta, cyan, and yellow inks are housed in the ink cartridges (not illustrated).

Configuration of Ink-Receiving Tray and Leg Portions

Next, the configuration of the ink-receiving tray 26 and the leg portions 28 will be described with reference to FIG. 6 to FIG. 13. As illustrated in FIG. 6 and FIG. 7, the ink-receiving tray 26 is formed in a box shape having an opening on the apparatus-height-direction upper side. The ink-receiving tray 26 is, for example, formed in a shape that covers the lower portion of the printer 10 by using a molding method such as vacuum molding or the like of a resin material such as PET (polyethylene terephthalate).

As illustrated in FIG. 6 and FIG. 7, the ink-receiving tray 26 includes a bottom portion 26*a* and a peripheral portion 26*b* which forms the periphery of the bottom portion 26*a*. The peripheral portion 26*b* is located above the bottom portion 26*a* in the apparatus height direction. Here, in the ink-receiving tray 26, the capacity of the region surrounded by the peripheral portion 26*b* of the ink-receiving tray 26, that is, the region from the bottom portion 26*a* to the top portion of the peripheral portion 26*b*, in other words, the ink housing capacity, is set to be equal to or larger than the capacity of ink that has filled the ink tube 42 at least from the recording head 32 up to the ink tube connecting portion 40*b* of the intermediate unit 40.

Even if the ink tube 42 is detached from the ink tube connecting portion 40*b* of the intermediate unit 40, ink can be prevented from leaking out from the intermediate unit 40 side by the check valve. Similarly, even if an ink cartridge (not illustrated) or the ink tubes 44A, 44B, 44C, and 44D are detached from the ink connectors 40*a*, it is possible to prevent the leakage of ink from the intermediate unit 40 side by the check valve.

Moreover, for example, as illustrated in FIG. 7, at least one ink absorber 46 serving as the "liquid absorber" is arranged on the bottom portion 26*a* of the ink-receiving tray 26. Moreover, a plurality of grooves 26*c* are formed in the bottom portion 26*a*. The plurality of grooves 26*c* are arranged on the bottom portion 26*a* so as to, in the case where ink has leaked from the assembly body 12 to the ink-receiving tray 26, guide the leaked ink to the ink absorber 46 by capillary action and thereby cause the ink to be absorbed by the ink absorber 46. For example, the grooves 26*c* are formed in a lattice pattern in the bottom portion 26*a*.

Moreover, a plurality of protrusions 48 (raised portions) are formed on the bottom portion 26*a* of the ink-receiving tray 26 so as to protrude upward in the apparatus height direction. Top portions 48*a* of the protrusions 48 are set so as to be higher than the top of the peripheral portion 26*b* in the apparatus height direction. Opening portions 48*b* are formed in the top portions 48*a* of the protrusions 48.

Furthermore, a plurality of protrusions 50 (raised portions) and at least one protrusion 52 (raised portion) are formed on the bottom portion 26*a* so as to project upward in the device height direction. The top portions of the protrusions 50 and the protrusion 52 are also set to be higher than the top portion of the peripheral portion 26*b*, and opening portions 50*a* and 52*a* are respectively formed in the top portions of the protrusions 50 and the protrusion 52.

Here, referring to FIG. 11, the highest position of the liquid surface of the ink that has leaked into the ink-receiving tray 26 in the device height direction becomes the same as the height of the top portion of the peripheral portion 26*b* of the ink-receiving tray 26. In addition, the imaginary line denoted by reference sign S in FIG. 11 indicates the height of the liquid surface when the maximum capacity of ink is housed in the ink-receiving tray 26.

Because the top portions 48*a* of the protrusions 48 and the top portions of the protrusions 50 and the protrusion 52 are set higher than the top portion of the peripheral portion 26*b* in the apparatus height direction, the liquid surface (refer to imaginary line S) when the maximum capacity of ink is housed does not reach the top portions 48*a* of the protrusions 48 and the top of the protrusions 50 and the protrusion 52, and the ink housed in the ink-receiving tray 26 can be prevented from leaking out from the opening portions 48*b*, 50*a*, and 52*a*.

Next, attachment of the ink-receiving tray 26 and the leg portions 28 to the assembly body 12 will be described with reference to FIG. 2, and FIG. 8 to FIG. 11. Referring to FIG. 8, two lower frames 56 are attached with a space separating them in the apparatus width direction to a bottom frame 54 that forms the bottom portion of the assembly body 12. The ink-receiving tray 26 is attached so as to cover the bottom frame 54 and the lower frames 56 from the apparatus-height-direction lower side. In addition, in the bottom frame 54, for example, opening portions 54*a* are formed at positions corresponding to the ink absorber 46 arranged on the bottom portion 26*a* of the ink-receiving tray 26.

Here, also in the lower frames 56, protrusions 58 (refer to FIG. 8 and FIG. 9) that protrude in the apparatus height direction are formed at positions corresponding to the protrusions 48 of the ink-receiving tray 26. In top portions 58*a* of the protrusions 58, for example, threaded holes 58*b* (refer to FIG. 10) are respectively formed. Referring to FIG. 10, when the ink-receiving tray 26 is attached in a state in which the lower frames 56 are attached to the bottom frame 54, the protrusions 48 of the ink-receiving tray 26 enter below the protrusions 58 of the lower frames 56, that is, the inner spaces of the protrusions 58.

Here, the leg portions 28 are, for example, formed of a material having both high friction and elasticity such as rubber, or a high friction material or an elastic material. Through holes 28*a* are formed in the leg portions 28. In a state where at least a part of the leg portions 28 has entered the internal space of the protrusions 48, by tightening fastening members 60 into the threaded holes 58*b* of the protrusions 58 of the lower frames 56 via the through holes 28*a* and the opening portions 48*b* of the protrusions 48, the leg portions 28 are attached to the lower frames 56. Screw members are given as an example of the fastening members 60.

Here, the leg portions 28 are arranged below the top portions 58*a* of the protrusions 58 of the lower frames 56 with the top portions 48*a* of the protrusions 48 of the ink-receiving tray 26 interposed therebetween. The weight of the assembly body 12 is borne by the leg portions 28 through the top portions 58*a* of the protrusions 58 of the lower frames 56 and the top portions 48*a* of the protrusions 48 of the ink-receiving tray 26. Here, because the top portions 48*a* of the ink-receiving tray 26 are only interposed between the top portions 58*a* of the protrusions 58 of the lower frames 56 and the leg portions 28, the assembly body 12 is supported by the leg portions 28. In other words, in the region surrounded by the peripheral portion 26*b* of the ink-receiving tray 26, because the leg portions 28 support the assembly body 12 via the lower frames 56, the ink-receiving tray 26 does not receive the load of the assembly body 12 to support the assembly body 12, and thus there is no risk of the ink-receiving tray 26 becoming deformed, or even if the ink-receiving tray 26 is deformed, the amount of deformation can be suppressed.

Moreover, the peripheral portion 26*b* of the ink-receiving tray 26 is arranged between an inner wall 14*a* of the housing 14 and the leg portions 28. Therefore, because the peripheral portion 26*b* of the ink-receiving tray 26 can be arranged outside the positions where the leg portions 28 are arranged, the size of the ink-receiving tray 26 can be increased, and ink can be received over a wide region with respect to the bottom portion of the assembly body 12 and, moreover, the maximum ink housing capacity in the ink-receiving tray 26 can be increased.

Moreover, the peripheral portion 26*b* of the ink-receiving tray 26 as illustrated in FIG. 10 extends diagonally toward the inner walls 14*a* of the housing 14. The peripheral portion 26*b* faces the inner wall 14*a*. Furthermore, the peripheral portion 26*b* is in contact with the inner wall 14*a*.

Attachment of the Second Medium Housing Unit

In the printer 10, for example, as shown in FIG. 4, it is possible to optionally attach the second medium housing unit 38 under the ink-receiving tray 26. Here, the attachment of the second medium housing unit 38 to the assembly body 12 will be described with reference to FIG. 12 and FIG. 13.

As illustrated in FIG. 12, a target positioning portion 62 that is cylindrical and that protrudes upward in the apparatus height direction from the bottom frame 54 is formed. For example, the target positioning portion 62 is provided in a plurality. The target positioning portions 62, in a state where the ink-receiving tray 26 is attached to the assembly body 12, are respectively formed at positions corresponding to the protrusions 50 formed on the ink-receiving tray 26 in the bottom frame 54.

Moreover, in the assembly body 12, in a state in which the ink-receiving tray 26 is attached to the assembly body 12, a connector portion 64 that protrudes from the opening portion 52*a* of the protrusion 52 toward the apparatus height direction lower side is provided. The connector portion 64 is connected to a cable 66 that extends up to a control unit (not illustrated) provided in the assembly body 12.

As illustrated in FIG. 13, positioning portions 68 that are pin like and that protrude toward the apparatus-height-direction upper side are provided in the second medium housing unit 38. At least a portion of the positioning portions 68 enters the internal space of the protrusions 50 when the second medium housing unit 38 is attached to the assembly body 12. The positioning portions 68 pass through the opening portions 50*a* of the protrusions 50 and are inserted into and engage with the target positioning portions 62, respectively. By inserting the positioning portions 68 into the plurality of the target positioning portions 62 and engaging the positioning portions 68 with the plurality of the target positioning portions 62, respectively, positioning of the second medium housing unit 38 is performed in the apparatus depth direction and the apparatus width direction with respect to the assembly body 12.

In the second medium housing unit 38, a connecting portion 70 is provided at a position corresponding to the protrusion 52 in a state in which the second medium housing unit 38 is attached to the assembly body 12. The connecting portion 70 protrudes from the second medium housing unit 38 toward the assembly body 12. When the second medium housing unit 38 is installed in the assembly body 12, at least one portion of the connecting portion 70 is inserted into the inner space of the protrusion 52. At least one portion of the connecting portion 70 is connected to the connector portion 64 via the opening portion 52*a*. The information of the second medium housing unit 38 is transmitted to the control unit (not illustrated) inside the assembly body 12 via the connector portion 64 and the cable 66.

For example, when the second medium housing unit 38 is attached to the assembly body 12, the second medium housing unit 38 supports the assembly body 12 at positions (not illustrated) different from the positioning portions 68 and the leg portions 28. That is, in a state in which the second medium housing unit 38 is attached to the assembly body 12, for example, the leg portions 28 and an upper surface 38*a* of the second medium housing unit 38 are separate from each other. Therefore, in a state in which the second medium housing unit 38 is attached to the assembly body 12, the weight of the assembly body 12 is not borne by the leg portions 28.

Modification Examples of Embodiment (1) Although the leg portions 28 are attached to the lower frames 56 by the fastening members 60, instead of this configuration, as shown in FIG. 14, the leg portions 28 may be attached by using a snap fitting method. Specifically, leg portions 72 are respectively provided with snap-fit portions 72*a*.

Moreover, in the top portions 58*a* of the protrusions 58 of the lower frames 56, opening portions 58*c* are formed instead of the threaded holes 58*b*. The snap-fit portions 72*a* of the leg portions 72 are made to pass through the opening portions 48*b* of the protrusions 48 of the ink-receiving tray 26 and the opening portions 58*c* of the protrusions 58 of the lower frames 56 to fix the leg portions 72 to the lower frames 56. Even with such a configuration, since the opening portions 48*b* and 58*c* are positioned further toward the upper side in the apparatus height direction than the peripheral portion 26*b* of the ink-receiving tray 26, it is possible to prevent ink from leaking out through the opening portions 48*b* and 58*c*. In addition, the imaginary line denoted by reference sign S in FIG. 14 indicates the height of the liquid surface when the maximum capacity of ink is housed in the ink-receiving tray 26.

(2) Although the ink absorber 46 is provided on the bottom portion 26*a* of the ink-receiving tray 26, instead of this configuration, a configuration in which the ink absorber 46 is not provided may be used.

(3) The leg portions 28 are attached to the lower frames 56 via the ink-receiving tray 26; however, instead of this configuration, a configuration in which the leg portions 28 are attached to the bottom frame 54 via the ink-receiving tray 26 may be used.

In summary, the printer 10 includes the recording head 32 that ejects ink onto a medium, the ink tanks 36A and 36B that house ink, the ink supply path 34 from the ink tanks 36A and 36B to the recording head 32, the assembly body 12 including the recording head 32, and, below the assembly body 12, the ink-receiving tray 26 for receiving ink leaking from the assembly body 12, the ink-receiving tray 26 having the opening portions 48*b*, 50*a*, and 52*a* which open at positions higher than the bottom portion 26*a*.

According to the above configuration, the ink-receiving tray 26 can receive ink leaking from the assembly body 12 including the recording head 32. Moreover, because the opening portions 48*b*, 50*a*, 52*a* are formed in the ink-receiving tray 26, it is possible to access the bottom of the assembly body 12 via the opening portions 48*b*, 50*a*, and 52*a*, and it is possible to provide the leg portions 28 and the like that, for example, receive the load of the apparatus. That is, while providing the ink-receiving tray 26, the degree of freedom of the configuration of the bottom portion of the apparatus can be secured, and, at the same time, a wide area of the ink-receiving tray 26 can also be secured. Because the opening portions 48*b*, 50*a*, and 52*a* open at positions higher than the bottom portion 26*a*, even when the ink staying at the bottom of the tray flows when the apparatus is tilted, ink does not easily flow from the opening portions 48*b*, 50*a*, and 52*a*. As described above, in the configuration providing the ink-receiving tray 26 that receives ink, leakage of ink can be avoided or suppressed while securing the degree of freedom of the configuration of the bottom of the apparatus.

The opening portions 48*b*, 50*a*, and 52*a* are located higher than the peripheral portion 26*b* of the ink-receiving tray 26. According to this configuration, it is possible to prevent or suppress the leakage of ink from the opening portions 48*b*, 50*a*, and 52*a* in the period until the ink-receiving tray 26 becomes full with the liquid.

The leg portions 28 for receiving the load of the assembly body 12 are attached to the lower frames 56 forming the lower portion of the assembly body 12 through the opening portions 48*b* and the peripheral portion 26*b* of the ink-receiving tray 26 is positioned between the inner wall 14*a* of the housing 14 and the leg portions 28 in directions intersecting the device height direction, that is, in the device width direction and the device depth direction. According to this configuration, a wide area of the ink-receiving tray 26 can be secured.

The peripheral portion 26*b* of the ink-receiving tray 26 extends toward the inner wall 14*a* of the housing 14 and faces the inner wall 14*a*. According to this configuration, it is possible to delay the timing at which the ink leaks out from the peripheral portion 26*b* when the apparatus is tilted.

The protrusions 48 protruding upward and having the opening portions 48*b* formed in the upper portion thereof are formed in the ink-receiving tray 26 and the leg portions 28 are attached to the lower frames 56 in a state where at least a portion of the leg portions 28 is inserted into the internal space of the protrusions 48. According to this configuration, the height of the apparatus including the leg portions 28 can be reduced.

The second medium housing unit 38 for housing the medium is provided on the lower side of the assembly body 12 and the ink-receiving tray 26, and the ink-receiving tray 26 is positioned between the assembly body 12 and the second medium housing unit 38. According to this configuration, it is possible to prevent or suppress the adhesion of ink to the second medium housing unit 38.

The protrusions 50 protruding upward and having the opening portions 50*a* formed in the upper portion thereof are formed in the ink-receiving tray 26. The positioning portions 68 that protrude toward the assembly body 12, that engage with the assembly body 12 and that set the position of the assembly body 12 are formed in the second medium housing unit 38 and the positioning portions 68 engage with the assembly body 12 via the opening portions 50*a* in a state in which at least a portion of the positioning portions 68 enters the internal space of the protrusions 50. According to this configuration, the height of the apparatus including the second medium housing unit 38 can be reduced.

The protrusion 52 protruding upward and having the opening portion 52*a* formed in the upper portion thereof is formed in the ink-receiving tray 26. The connecting portion 70 that protrudes toward the assembly body 12 and that connects to the assembly body 12 is formed in the second medium housing unit 38 and the connecting portion 70 connects to the assembly body 12 via the opening portion 52*a* in a state in which at least a portion of the connecting portion 70 enters the internal space of the protrusion 52.

The ink-receiving tray 26 is provided with the ink absorber 46. According to this configuration, it is possible to suppress the flow of ink inside the ink-receiving tray 26 and to suppress the leakage of ink from the ink-receiving tray 26.

The intermediate unit 40 which includes a check valve is provided in the ink supply path 34 from the ink tanks 36A and 36B to the recording head 32, and the liquid housing capacity of the ink-receiving tray 26 is equal to or larger than the capacity of ink in the case where the ink supply path 34 is filled with ink at least between the intermediate unit 40 and the recording head 32. According to this configuration, even a situation where the ink leakage capacity is maximum (worst) can be dealt with.

The ink-receiving tray 26 does not bear the load of the assembly body 12. According to this configuration, it is possible to prevent deformation of the ink-receiving tray 26.

Moreover, in this embodiment, even though the ink-receiving tray 26 according to the disclosure is applied in an ink jet printer as an example of a recording apparatus, it is possible to generally apply this to other liquid ejecting apparatuses.

Here, a liquid ejecting apparatus uses an ink jet type recording head, is not limited to a recording apparatus such as a printer that performs recording on a recording medium by discharging ink from a recording head, a photocopier or a facsimile machine, and may be a device that attaches a liquid to a target ejecting medium by ejecting, instead of ink, a liquid corresponding to the purpose to the target ejecting medium corresponding to the target recording medium from a liquid ejecting head corresponding to the ink jet type recording head.

Examples of a liquid ejecting head other than the recording head include a color material ejecting head used for the manufacture of color filters such as those of liquid crystal displays, an ejecting head used for ejecting electrode materials (conductive paste) used for the formation of electrodes such as those of an organic electroluminescence (EL) display or a field effect display (FED), a bioorganic substance ejecting head used in the manufacture of biochips, and a specimen ejecting head as a precision pipette.

In addition, the disclosure is not limited to the above described embodiments, and it goes without saying that it is possible to make various modifications within the scope of the disclosure described in the claims and that these are included in the scope of the disclosure.

What is claimed is:

1. A recording apparatus comprising:

a recording head that ejects a liquid onto a medium, a liquid housing unit that houses the liquid, a supply path of the liquid from the liquid housing unit to the recording head, an assembly body that includes the recording head, the liquid housing unit, and the supply path, a lower frame that forms a lower portion of the assembly body, a liquid-receiving tray that is arranged below the lower frame and that has a bottom portion that stores the liquid leaking from the recording head, the liquid housing unit, and the supply path and that has an opening portion that opens at a position higher than the bottom portion, and a leg portion that is fixed to the lower frame via the opening portion and that receives the load of the assembly body.

2. The recording apparatus according to claim 1, wherein the opening portion is arranged inside a peripheral portion of the liquid-receiving tray and is formed at a position higher than the peripheral portion.

3. The recording apparatus according to claim 1 further comprising:

a housing that covers the assembly body, wherein the peripheral portion of the liquid-receiving tray is positioned between an inner wall of the housing and the leg portion in a direction intersecting an apparatus height direction.

4. The recording apparatus according to claim 3, wherein the peripheral portion of the liquid-receiving tray extends toward the inner wall of the housing and faces the inner wall.

5. The recording apparatus according to claim 1, wherein a protrusion that protrudes upward and in which the opening portion is formed in an upper portion thereof is formed in the liquid-receiving tray, and the leg portion is fixed to the lower frame in a state in which at least one portion of the leg is inserted into an inner space of the protrusion.

6. The recording apparatus according to claim 1 further comprising:

a medium housing unit that houses a medium and that is disposed on a lower side of the assembly body and the liquid-receiving tray, and wherein the liquid-receiving tray is located between the assembly body and the medium housing unit.

7. The recording apparatus according to claim 6, wherein a protrusion that protrudes upward and in which the opening portion is formed in an upper portion thereof is formed in the liquid-receiving tray, a positioning portion protruding toward the assembly body and engaging with the assembly body so as to set a position of the assembly body is formed in the medium housing portion, and the positioning portion engages with the assembly body through the opening portion with at least a portion of the positioning portion entering the internal space of the protrusion.

8. The recording apparatus according to claim 6, wherein a protrusion that protrudes upward and in which the opening portion is formed in an upper portion thereof is formed in the liquid-receiving tray, a connecting portion that protrudes toward the assembly body and that is connected to the assembly body is provided in the medium housing unit, and the connecting portion comes into contact with the assembly body through the opening portion with at least a portion of the connecting portion entering the internal space of the protrusion.

9. The recording apparatus according to claim 1, wherein a liquid absorber that absorbs liquid is provided in the liquid-receiving tray.

10. The recording apparatus according to claim 9, wherein an intermediate unit that includes a check valve is provided in the supply path from the liquid housing unit to the recording head, and a liquid storage capacity of the liquid is equal to or larger than a capacity of the liquid when the liquid fills at least the supply path of the liquid between the intermediate unit and the recording head.

11. The recording apparatus according to claim 1, wherein the liquid-receiving tray does not bear the load of the assembly body.

* * * * *